US005221031A

United States Patent [19]

Prigmore

[11] Patent Number: 5,221,031

[45] Date of Patent: Jun. 22, 1993

[54] BODY-MOUNTED CUTTING APPARATUS

[76] Inventor: Raymond L. Prigmore, 7817 Deschuttes Way, Palo Cedro, Calif. 96073

[21] Appl. No.: 806,596

[22] Filed: Dec. 11, 1991

[51] Int. Cl.[5] ..... A45F 5/00

[52] U.S. Cl. ..... 224/267; 224/219; 224/901; 30/329

[58] Field of Search ..... 224/222, 219, 221, 232, 224/233, 267, 901, 914; 206/352, 353; 30/151, 162, 329

[56] References Cited

U.S. PATENT DOCUMENTS

| | | | |
|---|---|---|---|
| 1,274,312 | 7/1918 | Nicoll | 224/222 |
| 2,321,706 | 6/1943 | Sabbury | 30/151 |
| 2,840,903 | 7/1958 | Christensen | 30/162 |
| 3,581,326 | 6/1971 | Hayes | 7/144 |
| 4,341,331 | 7/1982 | McDougall | 224/222 X |
| 4,498,615 | 2/1985 | Johnson | 224/274 |
| 4,500,019 | 2/1985 | Curley, Jr. | 224/222 |
| 4,509,667 | 4/1985 | Meldrum | 224/901 X |
| 4,541,556 | 9/1985 | Collins et al. | 224/232 X |
| 4,579,265 | 4/1986 | Schiller | 224/229 |
| 4,675,996 | 6/1987 | DuBuque | 30/151 X |
| 4,690,316 | 9/1987 | Peterson | 224/253 |
| 4,733,808 | 3/1988 | Turner et al. | 224/219 |
| 4,805,818 | 2/1989 | Harrison | 224/232 |
| 4,953,770 | 9/1990 | Bond | 224/250 |
| 4,961,523 | 10/1990 | Stimac | 224/232 |
| 4,966,322 | 10/1990 | Zagorski et al. | 224/267 |

*Primary Examiner*—Henry J. Recla
*Assistant Examiner*—Glenn T. Barrett
*Attorney, Agent, or Firm*—Joseph E. Gerber

[57] ABSTRACT

A body-mounted cutting apparatus comprised of a band able to encircle a body limb and a cutting tool are disclosed. The band is of an elastically extensible fabric and bears releasably fastenable hook and loop fabric patches on its ends. The band also has such a fabric patch along its length which is adapted to engage a mating patch on a cutting tool. The cutting tool is comprised of a flattened handle sleeve having a cutting edge carrier slidably disposed, and frictionally positionable, therein.

10 Claims, 1 Drawing Sheet

BODY-MOUNTED CUTTING APPARATUS

BACKGROUND OF THE INVENTION

1. Field Of The Invention

The present invention relates generally to cutting apparatus, and more specifically to a body-mounted, detachable cutting tool.

2. Description Of The Related Art

Those working in trades where continual use and laying aside of a cutting tool is required find that the cutting tool is frequently misplaced, or set down in an orientation inconvenient for being re-grasped. Various holsters are known and used to keep cutting tools mounted on the body, and thus close at hand. However, those that may be described as sheaths are generally constructed so as to require that the blade of the cutting tool be oriented very precisely, e.g. coaxial with the sheath, before being introduced thereto. And, those that require lateral or other directional modes of introduction normally include such cumbersome-to-operate retention means as flaps, straps, snaps or clips. Other types of holsters that retain a cutting tool in a more ready, accessible orientation tend to permit the blade of the cutting tool to remain dangerously exposed.

Thus, it appears that a need exists for an apparatus that permits one using a cutting tool to, successively and continually, grasp the tool and then to lay the tool aside in a ready orientation, without having to manipulate any fastening device. Further, such apparatus should keep the blade of the cutting tool from being dangerously exposed during nonuse. And, a way to keep the cutting tool within close reach while working would also be desirable.

SUMMARY OF THE INVENTION

The body-mounted cutting apparatus of the present invention is adapted to overcome the above-noted shortcomings and to fulfill the stated needs. It first comprises an elongate, fabric band having opposing free ends able to overlap when encircling an arm, these ends including means for releasably fastening to one another. The apparatus further includes a cutting tool and, means for releasably fastening this cutting tool to the outer surface of the band.

The preferred cutting tool has a very slim profile and a retractable blade, features which make this cutting tool uniquely suited to the combination of the invention. And, the claimed inventive method of use of the apparatus greatly reduces the likelihood of the band thereof being detached from the arm.

Thus, it is an object of the present invention to provide a body-mounted cutting apparatus that permits one to successively and continually grasp the tool and then to lay the tool aside in a ready orientation, without having to manipulate any fastening device.

It is a further object of the present invention to provide a body-mounted cutting apparatus wherein the blade of the cutting tool is prevented from being dangerously exposed during nonuse.

Yet another object of this invention is to provide a body mounted cutting apparatus and method of use of same that result in secure attachment of a cutting tool to the user's arm.

Still further objects of the inventive body-mounted cutting apparatus disclosed herein will be apparent from the drawings and following detailed description thereof.

DESCRIPTION OF THE PREFERRED EMBODIMENT

Figure 1:
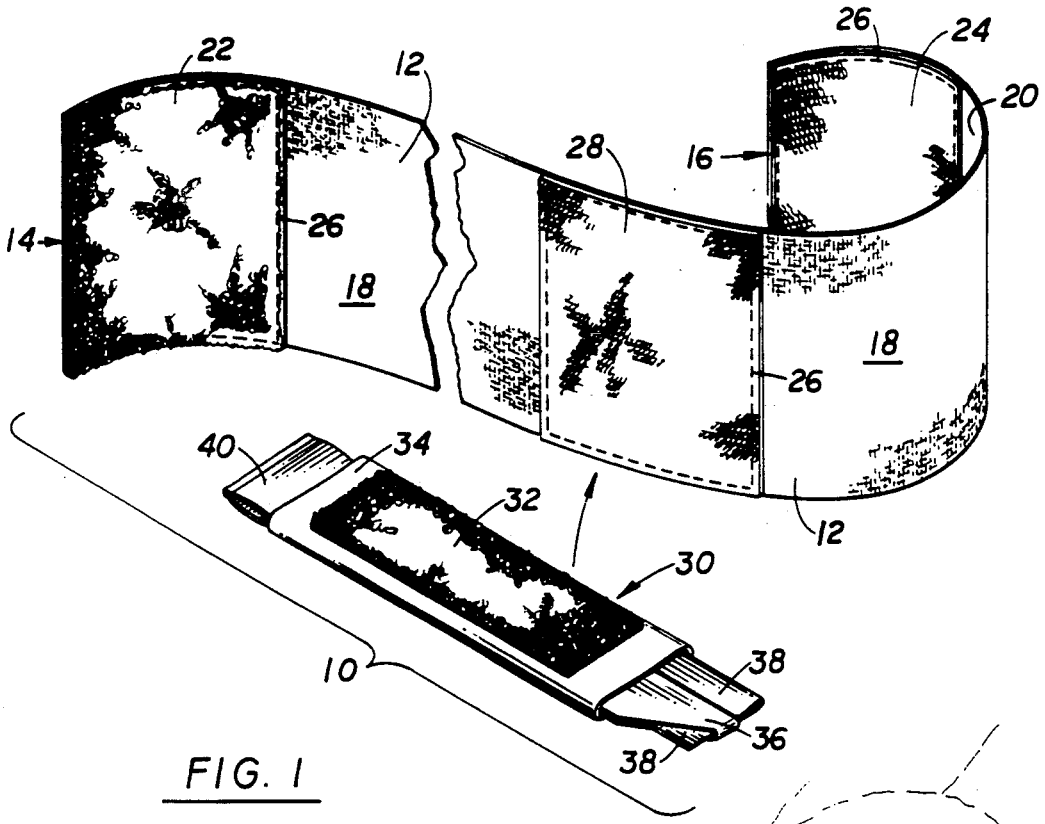
FIG. 1 is a perspective view of the body-mounted cutting apparatus of the present invention, with the cutting tool detached therefrom and having its blade exposed.
Figure 2:
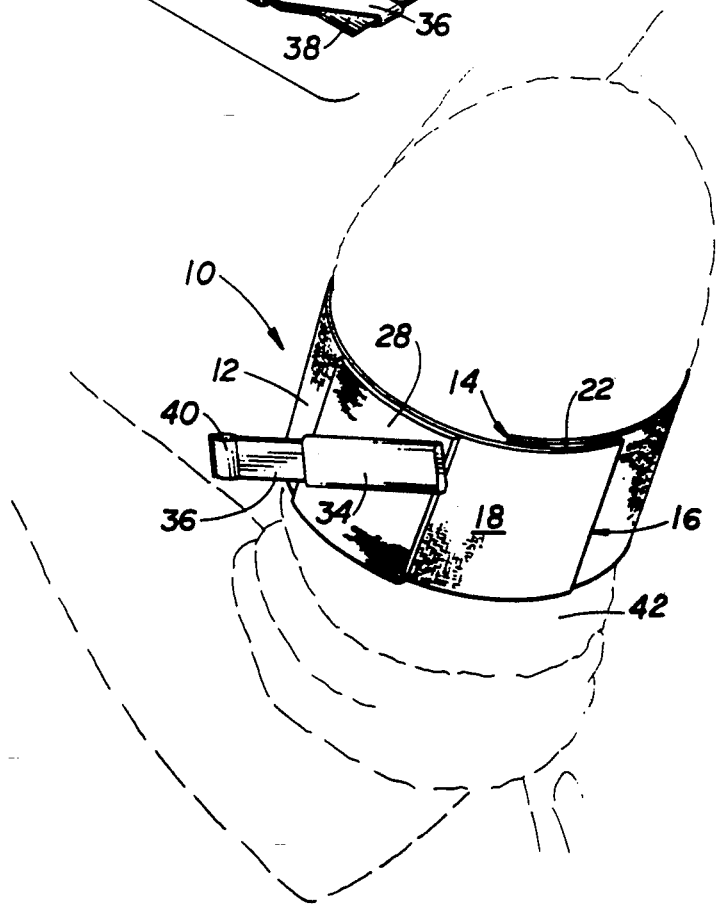
FIG. 2 is a perspective view of the body-mounted cutting apparatus of FIG. 1 in place on an arm, with the cutting tool attached thereto and having its blade retracted into its sleeve.

Referring now specifically to the drawings, FIGS. 1 and 2 show the preferred embodiment of the inventive body-mounted cutting apparatus, the apparatus in its entirety being identified herein with reference numeral 10, as indicated in FIG. 2.

As shown in FIG. 1, a primary element of apparatus 10 is an elongate fabric band 12. Band 12 is preferably constructed of a strip of fabric roughly 2" wide and 12–13" long. These dimensions may vary to accommodate the needs and comfort of users of apparatus 10, and to adapt the apparatus to the different fabric types which may be employed in its construction. The currently preferred fabric is a woven belt material constructed of synthetic fiber having an elastically extensible character. Although nonelastic fabric may also yield satisfactory results, elastic fabric has been found to work better in keeping the apparatus in place on a user's arm or other body limb.

Band 12 has first and second opposing ends, these ends being identified in the drawings by reference numerals 14 and 16, respectively. Band 12 also has outer and inner faces, these faces being identified in the drawings by reference numerals 18 and 20, respectively.

Ends 14 and 16 bear a mating pair of fabric patches which permit these ends to be releasably fastened to one another. As best seen in FIG. 1, first end 14's mating fabric patch 22 has a looped structure and is affixed to outer face 18. Second end 16's mating fabric patch 24 has a hooked structure and is affixed to inner face 20. Patches 22 and 24 are of the familiar type that may be pressed together, causing the loops of patch 22 to receive the hooks of patch 24, resulting in the ends of band 12, to which they are attached, being releasably fastened together. Such mating fabric is commonly available under the trademark "Velcro." Patches 22 and 24 are roughly square, and 2"×2" in size in the preferred embodiment of the invention. These patches are bound to the extreme ends of band 12 such that an edge of looped patch 22 is aligned with the band's terminal edge at first end 14, and so that an edge of hooked patch 24 is aligned with the band's terminal edge at second end 16. Mating patches 22 and 24 may be affixed to band 12 in any conventional way, stitches 26 having been found to work well for this purpose. Adhesives may also suffice.

Band 12 bears an additional mating fabric patch, this being referred to herein as mid-band patch 28 and being affixed to band 12's outer face 18. Mid-band patch 28 is roughly 2"×2" in size and is preferably positioned on outer face 18 such that when the entire apparatus is being worn by a user, as shown in FIG. 2, mid-band patch 28 is in a position easily accessible to the user's opposing hand. Patch 28 is preferably hooked fabric, as is further explained below. Stitching is the preferred method of affixing patch 28 to band 12 but, again, adhesives may also suffice.

Patch 28 is adapted to receive a cutting tool 30, which is preferably of a known type commonly referred to as a "case knife." Cutting tool 30 bears a mating fabric patch which is complementary to, and therefore able to bind to, mid-band patch 28. This fabric patch is referred to herein as the cutting tool patch, and identified with reference numeral 32. Cutting tool patch 32 is adhesively affixed to the rigid, flattened handle sleeve 34 of cutting tool 30. Handle sleeve 34 houses a rigid, elongate cutting edge carrier 36 slidably disposed therewithin. Carrier 36 is somewhat longer than sleeve 34 and has a forward slot (unnumbered) for receipt of a razor blade 38. Carrier 36 also has a rearward stop 40. Sleeve 34 makes frictional contact with carrier 36, thus permitting one to be selectively securely positioned with respect to the other. Two general modes are possible. In a first mode, as shown in FIG. 1, the forward, razor blade-bearing end of carrier 36 projects from sleeve 34, and rearward stop 40 abuts sleeve 34's opposing end. In this mode, the blade of cutting tool 30 is exposed for use. And, as shown in FIG. 2, a second mode is possible wherein the forward, blade-bearing end of carrier 36 is retracted within sleeve 34, and wherein carrier 36's rearward stop 40 is drawn away from sleeve 34. For safety, it is preferred that cutting tool 30 always be in this second mode when fastened, via the mating fabric patches, to band 12.

Several alternative orientations of the mating fabric patches on band 12 and cutting tool 30 are possible. Of course, for patches 22 and 24 to mate properly when apparatus 10 is in place on a user's arm, they must be on opposing faces of band 12, as is described above, and as is best seen in FIG. 1. However, the placement of patch 22 and 24 may be swapped with respect to the ends of band 12, so that the outer face of first end 14 has a hooked patch and the inner face of second end 16 has a looped patch, without departing from the spirit of the invention. This may be desirable if the apparatus is to be worn over the sleeve of a garment having a surface particularly vulnerable to being damaged by contact with a hooked fabric patch. That is, to protect such a garment, it is preferable that the hooked patch not be on that surface of band 12 likely to contact the garment.

As noted above, mid-band patch 28 is preferably hooked fabric; thus, cutting tool patch 32, in that case, is looped. This is the most desirable orientation, as it has been found that when the cutting tool carries the hooked fabric patch, in time, its hooks tend to mar the surface of band 12 immediately adjacent to mid-band patch 28.

In use, band 12 is donned by wrapping it around the bicep of the arm, positioning hooked patch 24 so it registers with looped patch 22, and pressing these patches into secure engagement with one another. (To establish a frame of reference for the following further explanation of use, the forward part of the bicep of the arm will be that surface having the same exposure as the chest of the user's body, the rear of the bicep will be that having the same exposure as the user's back, the inside of the bicep will be the surface under the arm opposing the ribs, and the outside will be that surface farthest away from the rest of the body.) Patches 22 and 24 are preferably overlapped and pressed together at the forward part of the bicep, that being the part of the bicep most easily accessed by the opposing hand. Once secured, band 12 should be rotated approximately one third of a turn around the outside of the bicep so as to orient the region of closure of patches 22 and 24 toward the rear of the bicep, as shown in FIG. 2. Of course, for this to work properly, in constructing apparatus 10 mid-band patch 28 should be affixed to band 12 in such a position as to result in patch 28 being oriented to the outside of the bicep.

Further, care should be taken to assure that second end 16 projects rearward, thus minimizing the likelihood that the user's movements, most of which are likely to be forward, will cause exposed end 16 to catch on a passing object and release band 12 from the arm. Further, it is important that the user, while reaching to grasp the cutting tool, does not disturb the secure closure between ends 14 and 16. To achieve this orientation, it is first necessary to note that, when looking down the arm's axis in a proximal to distal direction, band 12 may be affixed in either a right or a left-handed concentrically-wrapped orientation about the arm. Using this frame of reference, the left-handed wrapping direction yields the preferred orientation with second end 16 projecting toward the rear of the bicep.

Once band 12 is in place, cutting tool 30 may be secured to band 12, via engagement of looped cutting tool patch 32 with mid-band patch 28, in any orientation most comfortable to the user. This orientation will generally be as shown in FIG. 2, wherein the long axis of cutting tool 30 is disposed diagonally across the arm's long axis, and the stop 40 of carrier 36 projects from handle sleeve 34 in a slightly downward direction. This is the orientation that naturally results when cutting tool 30, initially held across the palm of the hand by wrapping the fingers thereover, is transferred into engagement with mid-band patch 28 by swinging the tool-holding right hand across to the left bicep. Once in place, cutting tool 30 remains securely in position able to be detached for use when needed. Upon detachment, the cutting edge of the tool is exposed by applying force to the stop 40 at the end of the cutting edge carrier 36 in a direction axial to the length of the tool. This can be accomplished by grasping the tool's handle sleeve 34 and driving stop 40 against a firm object. Likewise, when work with the tool is complete, the exposed blade bearing end of the cutting edge carrier may be driven against a firm object to sheath the blade within handle sleeve 34. And, the tool is as easily reengaged with patch 28 of band 12 when the time comes to set it aside by swinging the tool-holding right hand across to the left bicep and causing patches 28 and 32 to register and engage with one another. Indeed, in common parlance, it may be said that in use of the apparatus one may grab the tool off the band as needed and slap it back in place ready for the next use.

Of course, the above-described preferred orientation is reversed in the case of a left-handed user.

The foregoing detailed disclosure of the inventive body-mounted cutting apparatus 10, and method of using same, is considered as only illustrative of the preferred embodiment of, and not a limitation upon the scope of, the invention. Those skilled in the art will envision many other possible variations of the structure and method disclosed herein that nevertheless fall within the scope of the following claims. And, alternative uses for this inventive apparatus may later be realized. Accordingly, the scope of the invention should be determined with reference to the appended claims, and not by the examples which have herein been given.

I claim:

1. Body-mountable cutting apparatus, comprising:

a. an elongate, fabric band having opposing free ends and being of sufficient length to encircle an arm, such that said opposing ends of said band overlap when said band is encircling said arm;

b. means at said opposing free ends for releasably fastening said means to one another;

c. a cutting tool; and, d. means for releasably fastening said cutting tool to a surface of said band, wherein said releasable cutting tool fastening means comprises a mating fabric patch pair having a hooked portion and a looped portion, and wherein said hooked portion is bound to said band's surface and wherein said looped portion is bound to a surface of said cutting tool.

2. The apparatus of claim 1, wherein said cutting tool comprises a rigid, flattened, protective handle sleeve having a rigid cutting edge carrier slidably disposed, and frictionally-positionable, therein.

3. The apparatus of claim 1, wherein said releasable end fastening means comprises a mating fabric patch pair.

4. Body-mountable cutting apparatus, comprising:

a. an elongate, elastically extensible fabric band having opposing free ends and being of sufficient length to encircle an arm when said band is in a extended posture, and such that said opposing ends of said band overlap when said band is so extended;

b. means at said opposing free ends of releasably fastening said ends to one another;

c. a cutting tool comprising a rigid, flattened handle sleeve having a razor blade carrier slidably disposed, and frictionally-positionable, therein; and, d. means for releasably fastening said cutting tool to a surface of said band, wherein said releasable cutting tool fastening means comprises a mating fabric patch pair having a hooked portion and a looped portion, and wherein said hooked portion is bound to said band's surface and wherein said looped portion is bound to a surface of said flattened sleeve.

5. The apparatus of claim 1, wherein said releasable end fastening means comprises a mating fabric patch pair.

6. A method for holding a cutting tool in a ready position on an arm, comprising the steps of:

a. encircling said arm with an elastically extensible fabric band, said band having a first member of a mating fabric patch pair on an outer face thereof;

b. positioning said band so as to orient said first mating fabric patch member on an outer surface of said arm;

c. pressing a cutting tool bearing a second, and complementary, member of a mating fabric patch pair against and into releasably fixed engagement with said band's first mating fabric patch member, thus permitting said cutting tool to be successively and continually detached from an reengaged with said band.

7. The method of claim 6, wherein the step of encircling said arm with said band comprises the steps of wrapping opposing ends of said band around said arm's bicep and pressing mating fabric patches on said ends into releasably fixed engagement.

8. The method of claim 7, further including the step of positioning said band so as to orient an exposed end edge thereof toward said arm's rear surface.

9. The method of claim 6, further including the step, after detaching said cutting tool from said band, of applying force to an end of said cutting tool, thereby causing a cutting edge carrier within a handle sleeve of said tool to slide within said handle sleeve and to expose said cutting edge.

10. The method of claim 6, further including the step, before reengagement of said cutting tool with said band, of applying force to a cutting edge carrier projecting from an end of said cutting tool, thereby causing said cutting edge carrier to slide within a handle sleeve said tool and to cover a cutting edge carried by said cutting edge carrier.

* * * * *